United States Patent [19]

Reynolds et al.

[11] 4,003,472

[45] Jan. 18, 1977

[54] CRANE HOOK HEAVE COMPENSATOR AND METHOD OF TRANSFERRING LOADS

[75] Inventors: Thomas J. Reynolds, Lake Stevens; James P. Blanchet, Arlington, both of Wash.

[73] Assignee: Western Gear Corporation, Everett, Wash.

[22] Filed: Nov. 10, 1975

[21] Appl. No.: 630,359

[52] U.S. Cl. ..... 212/3; 214/14; 254/172

[51] Int. Cl.[2] ..... B66C 23/52

[58] Field of Search ..... 212/3, 39; 214/12–14; 254/188, 172; 294/67 E, 67 EA, 71 R; 114/144 B, 206 R, .5 D

[56] References Cited

UNITED STATES PATENTS

| | | | |
|---|---|---|---|
| 3,249,234 | 5/1966 | Trevisan | 212/3 |
| 3,512,657 | 5/1970 | Chambers | 214/13 |
| 3,945,508 | 3/1976 | Colin | 212/3 |

*Primary Examiner*—Robert J. Spar
*Assistant Examiner*—Lawrence E. Williams
*Attorney, Agent, or Firm*—Seed, Berry, Vernon & Baynham

[57] ABSTRACT

A floating barge crane that is provided with a heave compensator package between the traveling block of the crane and the load hook of the crane and with the package containing substantially all of the components of a hauldown system. The hauldown system includes four winches which carry hauldown cables that pass from the package to the load and to the stationary structure at circumferentially spaced points to pull the load toward the stationary structure and control lateral, vertical and rotational movement of the load.

12 Claims, 3 Drawing Figures

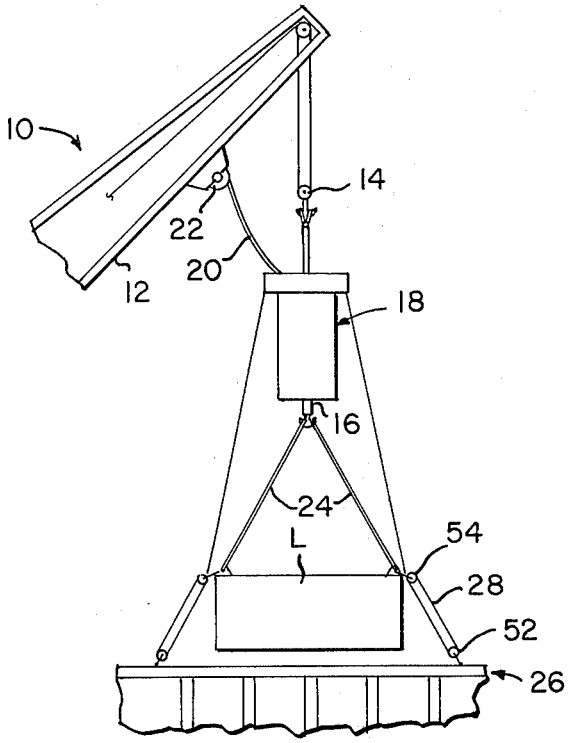
FIG. 1
FIG. 3
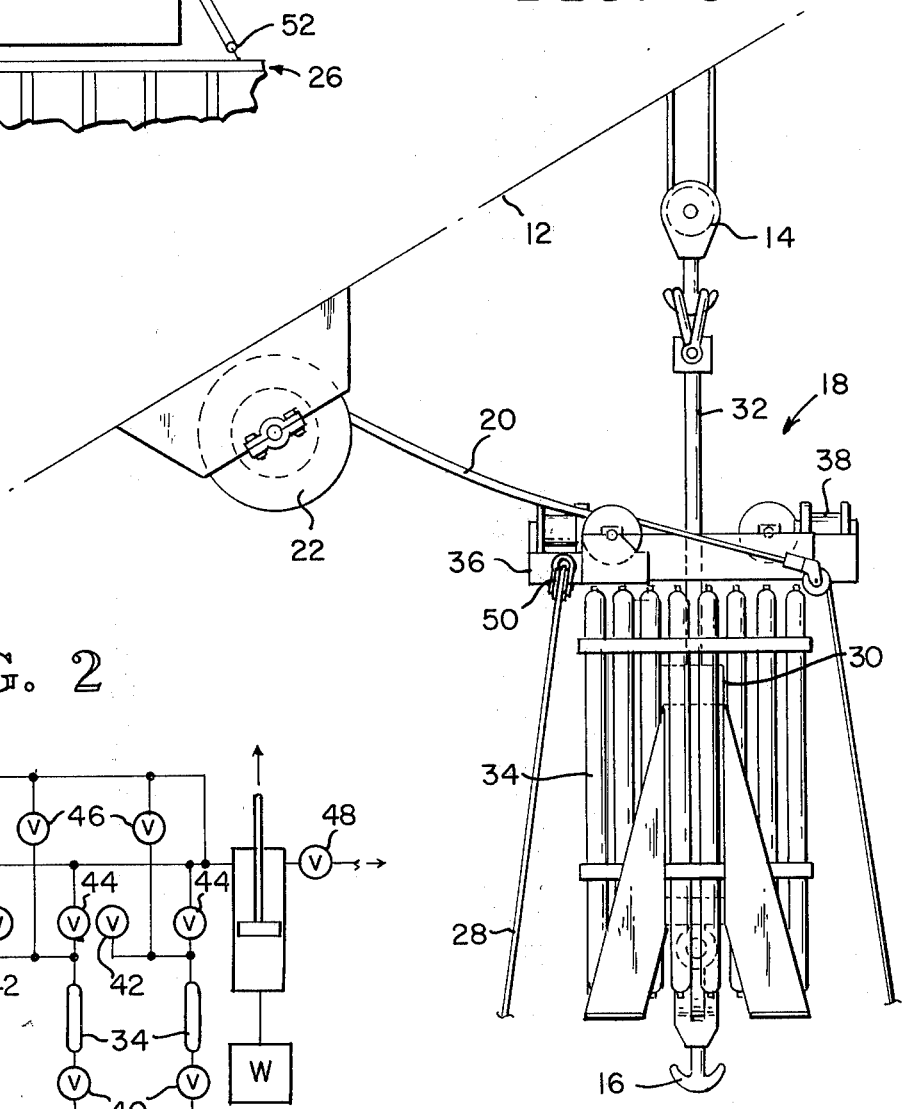
FIG. 2
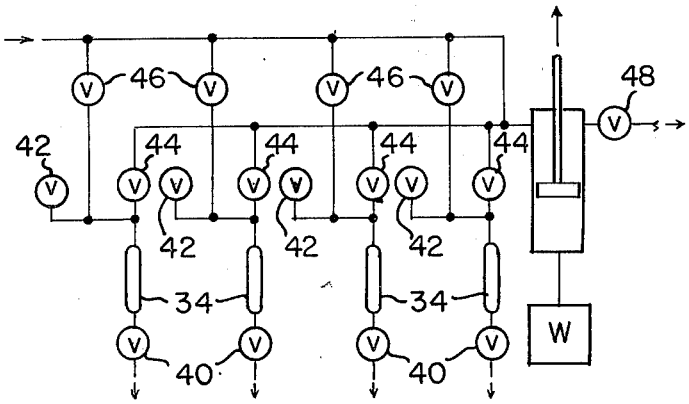

CRANE HOOK HEAVE COMPENSATOR AND METHOD OF TRANSFERRING LOADS

BACKGROUND OF THE INVENTION

1. Field of the Invention

This invention pertains to apparatus and methods for transferring heavy loads between first and second structures one of which is floating on heaving water and, more particularly, to a package suitable for use with a standard floating crane to convert the crane to one which has a heave compensating capability and an accurate fine positioning control of the load.

2. Description of the Prior Art

Various types of heave compensating devices have been used heretofor for enabling the transfer of loads from one structure to another where at least one of the structures is floating and subject to vertical displacement due to wave action. The problem of heave action becomes particularly severe as the size of the load increases, such as where a complete drilling or oilwell production module is to be transferred between a floating barge and a stationary offshore platform.

Some of the prior art devices have gone toward electronic synchronization of relative movements between the load and the stationary structure whereas others have employed heave compensating cylinders in some fashion for holding the load vertically stationary relative to the stationary structure during the loading and unloading of the load onto or off of the stationary structure. Typical examples of the latter devices are illustrated in the U.S. Pat. Nos. 2,817,212 and 2,907,172. The latter patent, in particular, also employs a hauldown system which pulls the load onto the stationary structure while overcoming the pressure in the heave compensating cylinders to provide a fine control of moving the load relative to the stationary structure.

The difficulty with the known prior art devices are their inherent costs and complicated nature. For example, in U.S. Pat. No. 2,907,172, a specially constructed barge is required for handling the heave compensating and hauldown system.

A second difficulty lies in the fact that the load is not only subjected to vertical motion relative to the stationary structure but in addition is subjected to horizontal lateral and horizontal rotational motion.

SUMMARY OF THE INVENTION

It is an object of this invention to provide a heave compensating package which contains also a hauldown system that is easily placed between the traveling block and the hook of a conventional floating crane to allow the crane to transfer loads over a wider range of sea conditions.

It is another object of this invention to provide an improved heave compensating package for a floating crane.

It is still another object of this invention to provide an improved hauldown system for use with a heave compensated floating crane.

These objects are best obtained by providing a package which includes an extensible heave compensating actuator, preferably a piston and cylinder, having one end connected to the traveling block of a floating crane and the other end connected to the load hook or its equivalent. The package contains its own air pressurization supply for the heave compensator cylinder and a plurality of hauldown winches whose cables and reeving systems can be quickly coupled between the load and the stationary platform for bringing the heave compensated package into operation. In the preferred embodiment four winches are employed with the reeving in the hauldown system being applied at four equidistantly spaced locations around the load so that simultaneously with the hauldown function the load is restrained against or positively allowed controlled lateral or rotational movement.

The advantage of such a package system is that it enables a standard floating crane to be modified to handle loads where uncontrolled relative movement between the load and the structure would be very damaging. For example, a typical load could be a production module weighing in excess of 100,000 tons. Thus, it is essential that this type of load when placed on a stationary offshore platform be lowered onto the platform without any rapid movement between the load and the platform. A second advantage is that the hauldown system provides lateral and rotational restraints or controlled movements and while being part of the package can be readily positioned for securement between the load and the stationary structure.

It is another object to provide an improved method of transferring loads between two platforms one of which is subjected to heaving motion relative to the other and controlling the positioning of the load.

This object is best obtained by connecting a heave compensator between the traveling block of the crane on one platform and the load hook of the crane and snubbing down the load onto the other platform against the pressure in the heave compensator and from spaced points around the load to provide vertical, lateral and horizontal rotational control to the load.

While the invention is described as being used for moving loads between a floating structure and a fixed structure, it should be understood that the invention is also suitable for moving loads between two floating structures.

BRIEF DESCRIPTION OF THE FIGURES OF THE DRAWINGS

FIG. 1 illustrates a typical heave compensating and hauldown package embodying the principles of the invention.

FIG. 2 is a schematic pressurizing system utilized in the package of FIG. 1.

FIG. 3 is an enlarged schematic of the package illustrated in FIG. 1.

DETAILED DESCRIPTION OF THE PREFERRED EMBODIMENTS

As best shown in FIG. 1, a conventional derrick barge 10 includes a boom 12 which carries a standard crown block and a traveling block 14. Interposed between the traveling block 14 and a traveling block load hook 16 is the heave compensating and hauldown package 18. An umbilical cable 20 is coupled to an umbilical winch 22 on the boom 12 for carrying the hoses and cables necessary to power the hauldown winches, compressor, and transmit the various control signals between the crane boom and the traveling heave compensator package. The hook 16 suspends the load by load cables 24. The load L is also coupled to the stationary platform or other structure 26 by snubbing or reeving systems having hauldown cables 28.

The heave compensator and hauldown package is best illustrated in FIG. 3 and includes a heave compensator cylinder 30 and a piston rod 32 of conventional construction. Secured to the cylinder is a bank of air bottles 34 and a frame work 36. The frame work 36 carries four conventional hauldown winches 38.

The heave compensating cylinder and auxiliary equipment, such as the air bottles, etc., are capable of operating at a cycling stroke rate of 10 feet in a 10 second period. For a total system dynamic capability of, for example, 2,600,000 pounds, a typical working pressure in the heave compensating cylinder above the piston is about 2,400 psi. The air bottles are standard commercial units with approximately 24 bottles each having 37 cubic foot capacity being used for a total volume of approximately 888 cubic feet. Each vessel is equipped with a drain valve 40 to allow periodic bleeding of possible condensation and contamination. The air bottles are arranged preferably in four groups of six units, each group being equipped with an air distribution manifold, a high pressure release valve 42, an isolation valve 44, and a charge selector valve 46. Also provided is a system bleeddown valve 48 to allow rapid lowering of the system air pressure. The isolation valves, charge selector valves, and bleeddown valve are remotely controlled from the operator's console via the umbilical cable 20. This piping and valving arrangement allows for incremental adjustment of the total air system spring rate and individual pressure vessel group charging from an air compressor. A suitable air compressor having an output of 90 SCFM at 2,400 psi can be employed.

Another unique feature of the invention is the use of a hauldown or snubbing system that provides highly accurate control of the vertical movement between the load and the stationary platform prior to actual contact between the two. In addition this system provides accurate lateral and rotational control of the load when attempting to land it on the platform either to move the load horizontally or prevent uncontrolled swinging of the load. Furthermore, the system can be used in the reverse mode for assisting the heave compensator in off-loading operations as well. The major components are the hauldown winches 38 each of which preferably has a full drum maximum line pull of 25,000 pounds. Each winch will carry a hauldown cable 28 which passes through a fair lead 50 and then through suitable sheave blocks. Sheave blocks 52 are secured to the stationary platform whereas sheave blocks 54 are secured to the load. These sheave blocks are located adjacent the corners of the load so that they are equidistantly spaced from one another about the load. By winching in, the load is pulled at four equidistantly spaced points preventing it from rotational or lateral movement.

In operation, prior to any lift, the system must be charged to the pressure required for the lift. In most cases, all air bottles are operational to give the softest possible spring rate. Next, the sling 24 is fastened to the hook and the hauldown winches are rigged. Next, the downhaul winch lines are tightened and the crane travelling block 14 hoisted until the heave compensator is close to fully extended during maximum heave. The downhaul winches are then released in conjunction with the travelling block being further hoisted. As the downhaul winch loads are relieved, the compensator through its air spring action will provide a quick initial lift-off of the load during an off-loading operation.

Placement of a load on a platform requires approximately the reverse of lift-off. The load is lowered to its final position off the stationary platform and the downhaul winches are rigged. The winches are then used to control the final lowering and placement of the load on the platform. Since a relatively constant spring force is acting between the piston and cylinder in the heave compensator, motion of the crane due to heave or wave action results in relative movement in the piston and the cylinder while the load remains relatively stationary relative to the platform 26. The exact final lowering into contact with the platform is thus achieved primarily by the hauldown rigging overcoming the force of the air pressure in the cylinder during the final few inches of movement. This contact can thus be made at a finely controlled rate to avoid sharp impact. Furthermore, limited lateral positioning can accurately be obtained by winching on selected ones of the hauldown cables.

While the preferred embodiments of the invention have been illustrated and described, it should be understood that variations will be apparent to one skilled in the arts without departing from the principles described here. Accordingly, the invention is not to be limited to the specific embodiment illustrated in the drawings or to the specific capacities suggested in the written description.

The embodiments of the invention in which a particular property or privilege is claimed are defined as follows:

1. In a load handling system for moving a heavy load between two platforms, at least one of which is floating and subject to heaving motion relative to the other, a heave compensator including cylinder means and piston means slidably mounted thereon and including a piston rod, one of said means being adapted to be connected to the load hook of a crane on one such platform and the other to a load to be lowered onto the other such platform, and snubber means carried by said other means of the heave compensator and being adapted to be connected to said other platform and to the load for resisting upward movement of the load relative to such other platform.

2. A load handling system according to claim 1 in which said snubber means comprises a plurality of powered winches carried by said other means of the heave compensator with each winch having a respective hauldown cable and a respective reeving system for each winch extending between said load and said other platform and including the respective said hauldown cable.

3. A load handling system according to claim 2 in which each said reeving system comprises a respective sheave block adapted to be connected to the load and another respective sheave block adapted to be connected to said other platform, the respective said hauldown cable being reeved through said sheave blocks to create a mechanical advantage.

4. A load handling system according to claim 2 in which each said reeving system comprises a respective sheave block adapted to be connected to said other platform and having the respective said hauldown cable reeved therethrough.

5. A load handling system according to claim 2 in which said snubber means includes four said reeving systems each coupled to a corner of the load to reduce lateral, vertical and rotational movement of the load.

6. A load handling system according to claim 1 in which extension of said piston rod relative to said cylinder means is resisted by compressed air in said cylinder means and pressure vessels for compressed air are carried by said other means of the heave compensator and are connected to said cylinder means.

7. A load handling system according to claim 1 in which said powered winches have control means extending from such winches to a control station remote from the heave compensator.

8. A method for lowering a heavy load to a given platform by a crane having a load hook end located on another platform, with at least one of said platforms floating and subject to heaving motion relative to the other, comprising:

connecting to the load hook of the crane a pressurized, extendable heave compensator with a stroke range at least twice that of the maximum heave range of said platforms relative to one another and connecting the load to the heave compensator, moving the crane to suspend the load over the desired location for the load on the given platform, connecting sheave blocks of reeving systems to the given platform at opposite sides of said location with the reeving systems connected at one end to the load and having hauling-in cables at their other end extending up from the sheave blocks to the heave compensator, and hauling in on said cables adjacent said heave compensator while lowering the load block so as to continually exert a downward force on the load as it is lowered to the given platform.

9. The method according to claim 8 in which said downward force exerted on the load by the reeving systems is increased relative to the pressure in the heave compensator when the load is adjacent the given platform so as to gradually extend the heave compensator and gently lower the load onto such platform while the heave compensator continues to perform its heave compensating function.

10. The method according to claim 8 in which lowering of said load hook is stopped and said downward force exerted on the load by the reeving system is increased relative to the pressure in the heave compensator when the load is above the given platform a distance equal to approximately one-half of said stroke range of the heave compensator so as to thereby continue lowering of the load onto the given platform by forced extension of the heave compensator while the heave compensator continues to perform its heave compensating function.

11. The method of claim 8, wherein said reeving systems apply downward forces at circumferentially spaced points around the load to restrict uncontrolled lateral and rotational movement of the load.

12. A method for lowering and positioning a heavy load to a desired location on a given platform by a crane located on another platform, with at least one of said platforms floating and subject to heaving motion relative to the other, connecting to the load hook of the crane a pressurized, extendable heave compensator and connecting the load to the latter so as to be movable vertically relative to the crane load hook by way of extension and retraction of the heave compensator, moving the crane to suspend the load approximately over the desired location, anchoring a plurality of hauldown reeving systems, which are connected to the load, to the given platform at circumferentially spaced anchoring points located outwardly of said desired location and with the reeving systems diverging downwardly from the load to said anchoring points, and operating said reeving systems to haul down the load in opposition to the heave compensator and at the same time shift the load horizontally relative to said anchoring points to position the load at said desired location.

* * * * *